United States Patent [19]

Follert et al.

[11] 4,122,683

[45] Oct. 31, 1978

[54] TUNNEL DRIVE SHIELD

[75] Inventors: Hans G. Follert, Dortmund; Klaus Linde, Lunen; Hans Jutte, Dortmund-Brechten, all of Fed. Rep. of Germany

[73] Assignee: Gewerkschaft Eisenhutte Westfalia, Lunen, Fed. Rep. of Germany

[21] Appl. No.: 785,891

[22] Filed: Apr. 8, 1977

[30] Foreign Application Priority Data

Apr. 8, 1976 [DE] Fed. Rep. of Germany ..... 26152647

[51] Int. Cl.[2] ..... E01G 3/02

[52] U.S. Cl. ..... 405/142; 299/31; 405/143

[58] Field of Search ..... 61/85, 84; 299/31; 175/97, 99, 230

[56] References Cited

U.S. PATENT DOCUMENTS

| | | | |
|---|---|---|---|
| 3,382,002 | 5/1968 | Tabor | 299/31 X |
| 3,630,574 | 12/1971 | Cox et al. | 299/31 |
| 3,870,368 | 3/1975 | Winberg et al. | 61/85 |
| 3,967,463 | 7/1976 | Grandori | 61/85 |

*Primary Examiner*—Jacob Shapiro

*Attorney, Agent, or Firm*—Sughrue, Rothwell, Mion, Zinn & Macpeak

[57] ABSTRACT

A tunnel drive shield is provided with a plurality of bracing units spaced around its periphery. The bracing units are expansible against the surrounding tunnel wall to control the direction of shield advance. A bracing unit is provided in each of the four shield quadrants defined by the vertical and horizontal center planes of the shield. Each of the bracing units is expansible in a non-radial direction.

7 Claims, 3 Drawing Figures

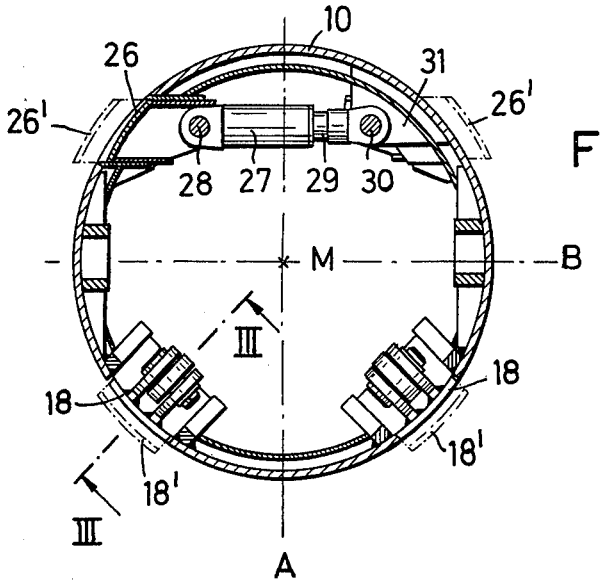
FIG.2
FIG.3
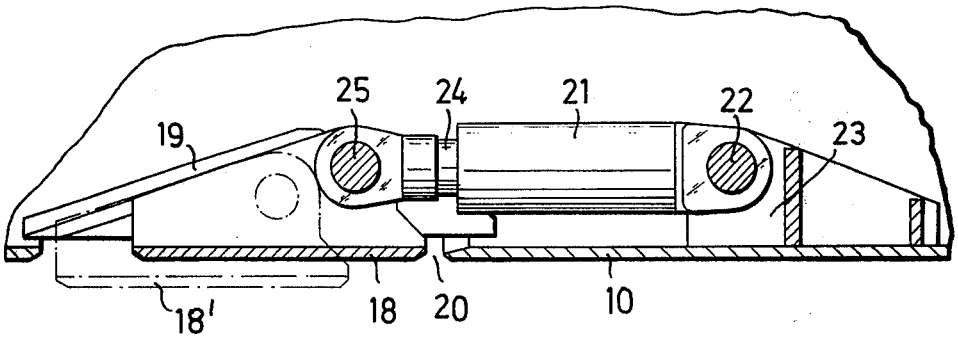

TUNNEL DRIVE SHIELD

This invention relates to a tunnel drive shield and to tunnelling apparatus incorporating a tunnel drive shield. Throughout this specification, the term "tunnel" or "tunnels" is intended to include galleries, trenches, adits or other similar elongated excavations.

It is known to provide tunnel drive shields with bracing units which can be expanded radially outwardly, in relation to the cylindrical cross-section of the shield to hold the shield firmly against the surrounding earth material. The disadvantage of this type of shield is that, as the bracing units move radially, they take up a relatively large proportion of the valuable space within the shield.

It is also known, from DT-OS-2,009,271, to use hydraulically operated bracing units to provide directional control of the shield advance. For example, the floor of the front portion of the shield is provided with a curved pad on which the shield can be rocked to control the direction of shield advance in the vertical plane. This rocking is effected by means of a pair of steering pads situated at the top and bottom of the rear portion of the shield. Similar steering pads are provided at the sides of the shield to control the direction of shield advance in the horizontal plane, these steering pads being diametrically opposed at the level of the horizontal plane of symmetry of the shield.

The main disadvantage of this type of shield is that the weight of the shield (and the heavy excavating machinery it contains) is taken almost entirely on the front rocking pad. Moreover, only one of the steering pads is available at any given time to control the direction of shield advance.

The aim of the invention is to provide a tunnel drive shield which does not have the disadvantages of the prior art shields.

SUMMARY OF THE INVENTION

The present invention provides a tunnel drive shield having a plurality of bracing units arranged around its periphery, the bracing units being expansible against the surrounding tunnel wall to control the direction of the shield advance, wherein a bracing unit is provided in each shield quadrant defined by the vertical and horizontal centre planes of the shield, and wherein each bracing unit is expansible in a non-radial direction.

Although tunnel drive shields are usually of right-circular-cylindrical form, it will be appreciated that they could also be of any other cylindrical form, and the terms "quadrant" and "radial" should be construed accordingly.

With this drive shield, it is always possible to use two bracing units to control the advance of the shield. Thus, to move the shield to the right, (as viewed in the direction of shield advance), the two units to the left of the vertical centre plane are expanded and if the shield is to be moved downwardly, the two units above the horizontal centre plane are expanded. Directional control of the shield is, therefore, achieved by the use of four bracing units which, preferably, are equispaced round the periphery of the shield.

Advantageously, the bracing units are mounted in substantially the same transverse plane of the shield. Preferably, at least the two bracing units positioned below the horizontal centre plane of the shield, are located adjacent to the front of the shield. Where all four bracing units are situated at the front of the shield, at least one pair of further bracing units may be provided on the shield, the units of the or each pair of further bracing units being situated above the horizontal centre plane of the shield and symmetrically with respect to the vertical centre plane of the shield, and the or each pair of further bracing units are spaced from the first-mentioned bracing units in the direction of the longitudinal axis of the shield. Preferably, there are two pairs of further bracing units, the two pairs of further bracing units being spaced apart in the direction of the longitudinal axis of the shield.

Preferably, each of the bracing units positioned below the horizontal centre plane of the shield is controlled by means of a hydraulic ram whose working stroke lies in a direction parallel to the longitudinal axis of the shield. In this case, each of said bracing units is constituted by a wedge-shaped shoe which is guided along a cam surface attached to the shield and inclined to the longitudinal axis of the shield. This results in a particularly good space saving arrangement as the hydraulic rams can be positioned parallel and close to the interior wall of the shield, and so can lie under a floor provided for supporting an excavator within the shield.

Advantageously, each bracing unit positioned above the horizontal centre plane of the shield and/or each further bracing unit is controlled by a hydraulic ram whose working stroke lies parallel to the horizontal centre plane of the shield and at right-angles to the vertical centre plane of the shield. This also results in a good space saving arrangement as these hydraulic rams can be located above the excavator.

The invention also provides tunnel driving apparatus comprising a drive shield as defined above and an excavator mounted on the floor of the shield, wherein the excavator is controlled independently of the bracing units.

The invention further provides tunnel driving apparatus comprising a drive shield as defined above and a trailer shield articulated to the rear end thereof by means of hydraulic advance rams whereby the drive shield can be advanced in any predetermined direction.

BRIEF DESCRIPTION OF THE DRAWINGS

Tunnel driving apparatus incorporating a drive shield constructed in accordance with the invention will now be described, by way of example, with reference to the accompanying drawings, in which:

FIG. 2 is a cross-section taken on the line II—II of FIG. 1; and

FIG. 3 is a cross-section taken on the line III—III of FIG. 2, and on an enlarged scale.

DESCRIPTION OF PREFERRED EMBODIMENT

Figure 1:
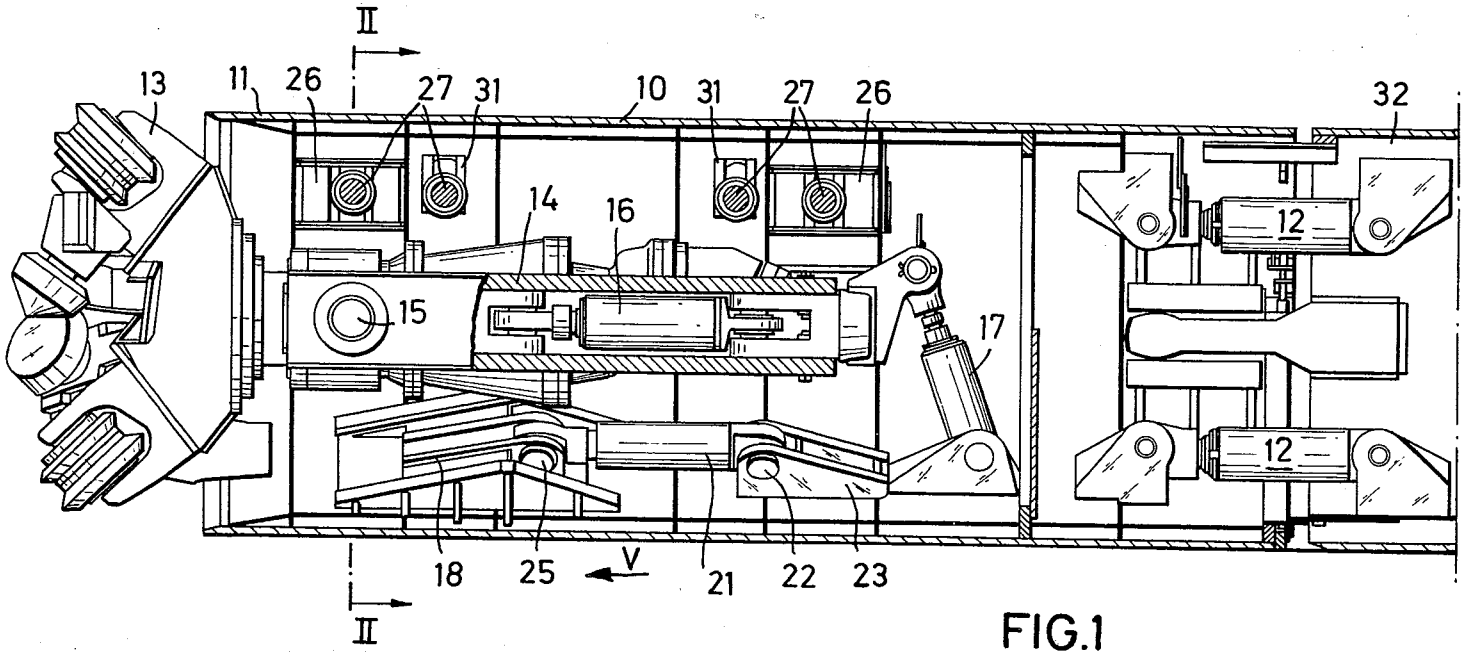
FIG. 1 is a longitudinal cross-section through the apparatus.

Referring to the drawings, the tunnel driving apparatus comprises a cylindrical drive shield 10 and an excavator E supported within the shield. The shield 10 is provided with a cutting portion 11 at its front end, and is movable in the direction of the arrow V by means of double-acting hydraulic advance rams 12 in a manner to be described below.

The excavator E is provided with a rotating cutting head 13 for cutting away rock or other material from the entire cross-sectional area of the tunnel, the head being mounted on a frame 14. The excavator E is provided with a pair of trunnions 15 which are journalled in diametrically opposed bearings (not shown) carried on the inside of the shield 10. The head 13 is advanced, relative to its frame 14, in the direction V by means of a hydraulic advance ram 16 accommodated within the frame. Pivotal movement of the head 13 in the vertical plane is controlled by means of a hydraulic control ram 17 which acts between the rear of the frame 14 and the floor of the shield 10. Similarly, pivotal movement of the head 13 in the lateral plane is controlled by means of a further hydraulic control ram (not shown). The head 13 can, therefore, be adjusted in all directions by means of the advance and control rams.

The shield 10 is provided with two pairs of bracing units 18 and 26 adjacent its front end. The bracing units 18 are positioned below the horizontal central plane B of the shield 10 and are positioned symmetrically with respect to the vertical control plane A. The two units 26 are similarly positioned symmetrically with respect to the plane A but above the plane B. A further pair of bracing units **26*a* are provided towards the rear of the shield 10, these units likewise being positioned above the plane B and symmetrically with respect to the plane A. The four bracing units 18 and 26 are positioned at 90° intervals around the circumference of the shield 10**, each unit being at an angle of 45° to both planes A and B.

As can best be seen in FIG. 3, each of the bracing units 18 includes a curved shoe having a wedge-shaped profile which is guided on a face 19 mounted on the inside of the shield 10. Each of the faces 19 is inclined to the longitudinal axis M of the shield 10, so that the force applied to its unit 18 by a corresponding double-acting hydraulic ram 21 (whose working stroke is parallel to the axis M) causes the unit 18 to move through a cut-out 20 in the shield and into contact with the surrounding tunnel wall. The expanded position of one of the units 18 is shown by dash-dotted lines 18' in FIG. 3. When the rams 21 are retracted, the curved surfaces of the shoes of the units 18 form continuations of the shield wall. The rams 21, being situated parallel to the axis M and adjacent to the interior wall of the shield 10, are positioned in a space-saving manner under the frame 14 of the excavator E.

The units of the two pairs of bracing units 26 and **26*a* are all identical, and so one of the units 26 only will be described. Each unit 26 is provided with a double-acting hydraulic ram 27 which is pivotally connected thereto at 28. The piston rod 29 of the ram 27 is pivotally connected, by means of a link 30, to a bracket 31 fastened to the inside of the shield 10, the bracket 31 and the unit 26 being substantially symmetrically disposed with respect to the plane A (see FIG. 2). The other unit 26 of this pair is positioned adjacent to the bracket 31 and its bracket (not shown) is positioned adjacent to the first unit 26. When the rams 27 are expanded, the units 26 assume the positions shown by dash-dotted lines 26' (see FIG. 2**) where they contact the surrounding tunnel walls.

As shown in FIG. 2, the bracing units 18 and 26 constitute a four-point contact system. Moreover, there are always two of these units 18 and 26 available for controlling movement either up or down or to the right or to the left (as viewed in the direction of advance). For example, if the shield is to be moved to the left, the right-hand (left-hand as seen in FIG. 2) units 18 and 26 are braced outwardly by the rams 21 and 27. The rams 21 and 27 of the other two units 18 and 26 (the left-hand ones) may also be braced outwardly but only for the purpose of supporting the shield 10 at that side of the tunnel. Obviously, in this case, the rams 21 and 27 of the left-hand units 18 and 26 are supplied with hydraulic fluid at a reduced pressure compared with that applied to the rams 21 and 27 associated with the right-hand units 18 and 26.

When the shield 10 is to be moved upwardly, the two units 18 are braced outwardly and the units 26 are then braced sufficiently to provide support for the shield in its raised position. On the other hand, when the shield 10 is to be moved downwardly, only the units 26 need to be braced, as the weight of the shield plus excavator E is sufficient to provide support in the floor region.

It will be understood that the units **26*a* are used in conjunction with the corresponding units 26 to provide an improved degree of shield advance direction control. It is, therefore, possible to move the whole shield 10 to any desired direction by appropriate bracing of the units 18, 26 and 26*a*. The shield 10 can then be anchored in the desired position by bracing all the units 18, 26 and 26*a***.

So that the shield 10 can respond to these control movements, its advance rams 12 act between the shield 10 and a trailer shield 32 via pivot joints 33. The trailer shield 32 is also provided with bracing units (not shown) which may be of the type described above. When the drive shield 10 is to be advanced, the trailer shield 32 is anchored by means of its bracing units. The rams 12 are then extended to advance the drive shield 10 in the direction determined by the state of the bracing units 18, 26 and **26*a*. When the drive shield 10 is fully advanced, all its bracing units 18, 26 and 26*a* are operated to anchor this shield, so that subsequent retraction of the trailer shield bracing units and retraction of the rams 12 causes the trailer shield 32** to follow up the advance of the drive shield.

We claim:

1. In a tunnel drive shield having a plurality of bracing units arranged around its periphery, the bracing units being expansible against the surrounding tunnel wall to control the direction of shield advance, the improvement comprising a bracing unit provided in each shield quadrant defined by the vertical and horizontal center planes of the shield, each bracing unit expansible by control means movable in a non-radial direction, each of said bracing units positioned below the horizontal center plane of the shield controlled by means of a hydraulic ram, said ram having working stroke lying in a direction parallel to the longitudinal axis of the shield.

2. A drive shield according to claim 1, wherein said bracing units are mounted in substantially the same transverse plane of the shield.

3. A drive shield according to claim 2, wherein said bracing units are located adjacent to the front of the shield.

4. A drive shield according to claim 3, wherein a pair of further bracing units is provided on the shield, the units of the pair of further bracing units being situated above the horizontal centre plane of the shield and symmetrically with respect to the vertical centre plane of the shield, and the pair of further bracing units are spaced from the first-mentioned bracing units in the direction of the longitudinal axis of the shield.

5. A drive shield according to claim 1, wherein each of said lower bracing units is constituted by a wedge-shaped shoe which is expansible through an opening in the shield and is guided along a cam surface attached to the shield and inclined to the longitudinal axis of the shield.

6. A drive shield according to claim 1, wherein each of said bracing units positioned above the horizontal centre plane of the shield is controlled by a hydraulic ram whose working stroke lies parallel to the horizontal centre plane of the shield and at right-angles to the vertical centre plane of the shield.

7. A drive shield according to claim 4, wherein each of said further bracing units is controlled by a hydraulic ram whose working stroke lies parallel to the horizontal centre plane of the shield and at right-angles to the vertical centre plane of the shield.

* * * * *